US005959594A

United States Patent [19]

Wu et al.

[11] Patent Number: 5,959,594

[45] **Date of Patent: *Sep. 28, 1999**

[54] DUAL POLARIZATION FREQUENCY SELECTIVE MEDIUM FOR DIPLEXING TWO CLOSE BANDS AT AN INCIDENT ANGLE

[75] Inventors: Te-Kao Wu, Rancho Palos Verdes; Brent T. Toland, Manhattan Beach, both of Calif.

[73] Assignee: TRW Inc., Redondo Beach, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,093

[22] Filed: Mar. 4, 1997

[51] Int. Cl.[6] ..... H01Q 15/02; H01Q 15/24

[52] U.S. Cl. ..... 343/909; 343/753; 343/756

[58] Field of Search ..... 343/909, 872, 343/753, 756, 795, 810, 812, 813, 866, 867; H01Q 15/02, 15/24, 19/06

[56] References Cited

U.S. PATENT DOCUMENTS

| | | | |
|---|---|---|---|
| 4,479,128 | 10/1984 | Brunner et al. | 343/909 |
| 4,786,914 | 11/1988 | Wu et al. | 343/909 |
| 5,130,718 | 7/1992 | Wu et al. | 343/909 |
| 5,140,338 | 8/1992 | Schmier et al. | 343/909 |
| 5,162,809 | 11/1992 | Wu | 343/909 |
| 5,373,302 | 12/1994 | Wu | 343/781 P |
| 5,543,809 | 8/1996 | Profera, Jr. | 343/909 |

OTHER PUBLICATIONS

Chao–Chun Chen, "Scattering by a Two–Dimensional Periodic Array of Conducting Plates," *IEEE Transactions on Antennas and Propagation*, vol. AP–18, No. 5, Sep. 1970, pp. 660–665.

Chao–Chun Chen, "Transmission of Microwave Through Perforated Flat Plates of Finite Thickness," *IEEE Transactions on Microwave Theory and Techniques*, vol. MTT–21, No. 1, Jan. 1973, pp. 1–6.

Leo Young, Lloyd A. Robinson and Colin A. Hacking, "Meander–Line Polarizer," *IEEE Transactions on Antennas and Propagation*, May 1973, pp. 376–378.

*Primary Examiner*—Hoanganh Le

*Attorney, Agent, or Firm*—Michael S. Yatsko; Connie M. Thousand

[57] ABSTRACT

A frequency selective medium that is adapted to receive an incident electromagnetic radiation at an angle of incidence of about 45° has two arrays of conductive elements on opposite parallel surfaces (20, 22) of a dielectric substrate. In one embodiment, the conductive elements are cross-dipoles (6) each having a horizontal dipole (10) and a vertical dipole (8) of different lengths and widths. In another embodiment, the conductive elements comprise a plurality of conductive gridded rectangular loops (40). The frequency selective medium allows incident waves that are within a passband of transmit frequencies to transmit through the medium, and reflects waves at frequencies within a stopband adjacent the passband. In other embodiments, meanderline polarizers (28) are added to cross-dipole and gridded rectangular loop frequency selective media to circularly or dual-linearly polarize incident linearly polarized waves.

23 Claims, 5 Drawing Sheets

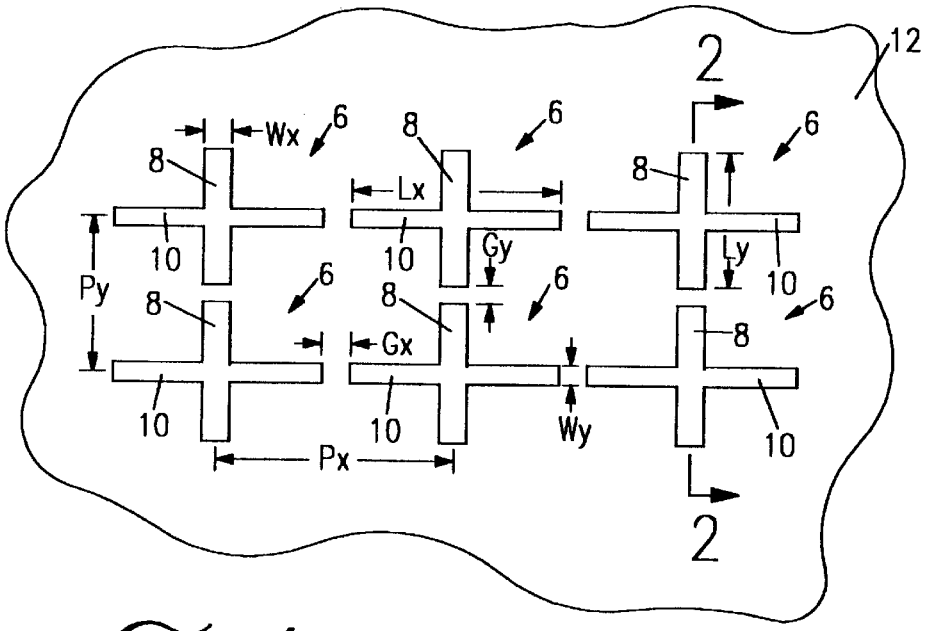
FIG. 1
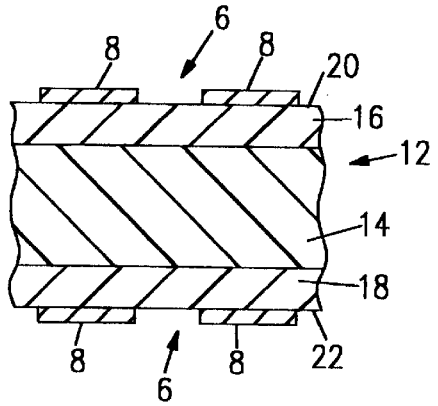
FIG. 2
FIG. 3
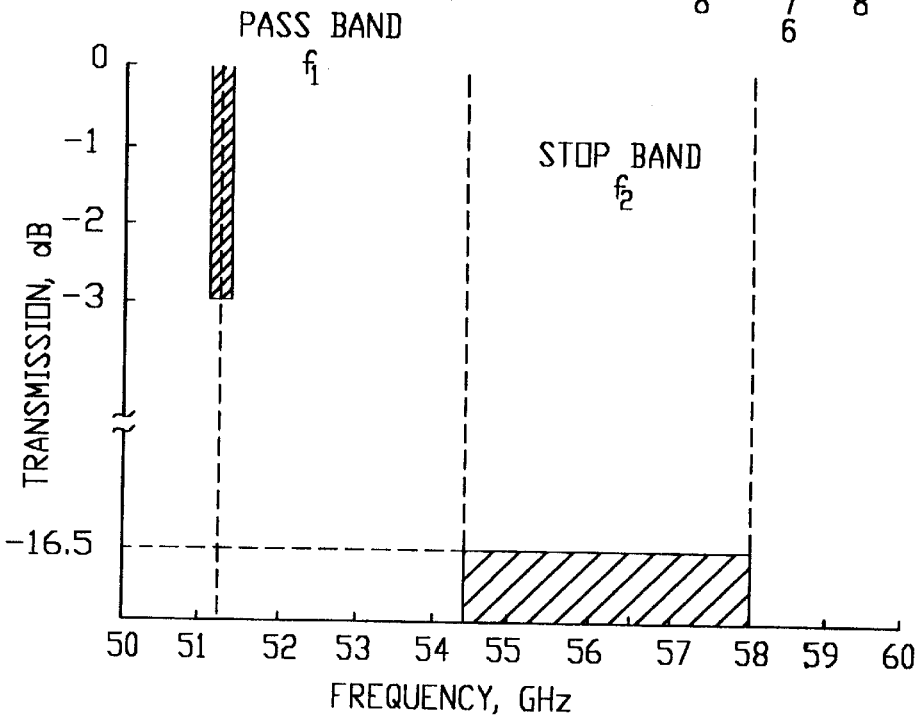

DUAL POLARIZATION FREQUENCY SELECTIVE MEDIUM FOR DIPLEXING TWO CLOSE BANDS AT AN INCIDENT ANGLE

This invention was developed during the course of contract or subcontract number 065331 for the Office of Secretary of Defense/Defense Support Office. The Government has certain rights in this invention.

BACKGROUND

This invention relates to a frequency selective medium for selectively reflecting signals at a designated frequency band and for selectively transmitting signals at another designated frequency band, and more particularly, for selectively transmitting and reflecting microwave and millimeter wave signals with an angle of incidence that is other than normal.

Frequency selective media have been used for passing a designated band of frequencies while rejecting another designated band of frequencies. A conventional frequency selective medium for diplexing two frequency bands has been described in U.S. Pat. No. 5,162,809, which discloses an array of square or circular open center conductor elements deposited on a substrate. Although this frequency selective medium is suitable for passing certain designated frequency bands and rejecting other frequency bands for an incident microwave radiation at an angle normal to the surface or at a very small angle of incidence, it is not designed for frequency diplexing of incoming radiation at a large angle of incidence. Moreover, the ratio of transmitted microwave signal frequency to the reflected signal frequency is about 1.15, which means that the separation between the passband and stopband may be too large for some applications with stringent diplexing requirements. U.S. Pat. No. 5,373,302 describes another frequency selective medium for frequency division multiplexing in a dual reflector antenna, also known as a Cassegrain antenna. This frequency selective medium is also suitable for the frequency selection of an incident wave at a very small angle of incidence. At a relatively large angle of incidence, for example 45°, a significant frequency shifting of the passband and the stop band for the vertical and horizontal polarizations occurs in these conventional frequency selective media. Therefore, they are not suitable for the frequency selection of incoming radiation at a large angle of incidence such as 45°.

Other conductive surface structures for the transmission and reflection of microwave radiation have been theoretically described in Chao-Chun Chen, "Scattering by a Two-Dimensional Periodic Array of Conducting Plates," *IEEE Transactions on Antennas and Propagation,* volume AP-18, No. 5, September 1970, pages 660–665, and Chao-Chun Chen, "Transmission of Microwave Through Perforated Flat Plates of Finite Thickness," *IEEE Transactions on Microwave Theory and Techniques,* vol. MTT-21, No. Jan. 1, 1973, pages 1–6. These structures are not designed for microwave diplexing, that is, to pass a band of transmit frequencies and to reflect a stopband of rejection frequencies that are higher than the transmit frequencies. Another type of microwave surface structure is a meanderline polarizer, described in Leo Young, Lloyd A. Robinson and Colin A. Hacking, "Meander-Line Polarizer," *IEEE Transactions on Antennas and Propagation,* May 1973, pages 376–378. When linearly polarized microwave radiation impinges upon the meanderline polarizer, either a circularly polarized or a dual-linearly polarized wave with a 90° phase difference emerges from the polarizer. These meanderline polarizers generally have a very wide passband and are not used for frequency diplexing.

SUMMARY OF THE INVENTION

In view of the problem of frequency selection for incoming radiation at a relatively large angle of incidence, more specifically, about 45°, and frequency diplexing of closely spaced passband and stopband, the present invention provides a frequency selective medium for selectively transmitting and reflecting incoming radiation at a relatively large angle of incidence. In accordance with the invention, a frequency selective medium comprises:

(a) a dielectric substrate with a first surface and a second surface that are substantially parallel with each other;

(b) a first array of conductive elements on the first surface; and (c) a second array of conductive elements on the second surface, the first and second arrays being adapted to selectively transmit and reflect an incident electromagnetic wave at an off-normal angle of incidence, based upon whether the frequency is within the passband or the stopband.

In one embodiment, the arrays of conductive elements are cross-dipole arrays each comprising a plurality of cross-dipoles. The cross-dipoles each have a horizontal dipole and a vertical dipole of different lengths and widths. In another embodiment, the arrays of conductive elements are gridded rectangular loop arrays which are placed on the two surfaces of the substrate to selectively pass and reflect an incoming radiation based upon its frequency. The dielectric substrate may have one or more layers of dielectric materials, such as a foam or a polyimide. A meanderline polarizer can be added to either type of frequency selective media to change the polarization of the incoming radiation. For example, if the incident wave is vertically polarized, the transmitted wave is either circularly or dual-linearly polarized while the reflective wave is horizontally polarized. Moreover, the passband and the stopband of the frequency selective medium can be designed closer to meet stringent diplexing requirements. The invention is also applicable to the frequency selection of incident waves at a variety of off-normal incidence angles.

BRIEF DESCRIPTION OF THE DRAWINGS

These and other features, aspects and advantages of the present invention will become understood with reference to the following description, appended claims and accompanying drawings where:

FIG. 1 is a plan view of a portion of a frequency selective medium according to the present invention with arrays of cross-dipoles;

FIG. 2 is a sectional view of the frequency selective medium of FIG. 1 taken along section line 2—2, showing a plurality of dielectric layers forming the substrate;

FIG. 3 is a plot of transmission vs. frequency showing the requirements of passband and stopband that can be met by the high quality factor (Q) frequency selective medium of the present invention;

DETAILED DESCRIPTION OF THE PREFERRED EMBODIMENTS

Figure 4:
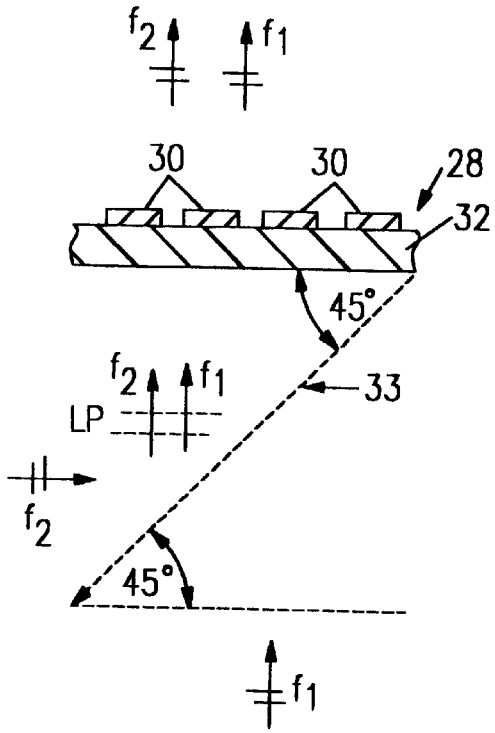
FIG. 4 is a sectional view of the frequency selective medium of FIGS. 1 and 2 with the addition of a meanderline polarizer.

The present invention provides a frequency selective medium for selectively transmitting and reflecting an incoming electromagnetic radiation at a relatively large angle of incidence, more specifically, about 45°, based upon the frequency of the incoming radiation. Specifically, a frequency selective medium passes an incident wave within a passband of radio frequencies and reflects waves at frequencies within a stopband. The stopband frequencies are higher than the passband frequencies, and the passband and the stopband can be placed closely adjacent each other. The incident wave can be either horizontally polarized or vertically polarized, and can have either a TE mode or a TM mode. Depending upon the desired bandwidths of the passband and the stopband and the desired polarization of the transmitted waves, the invention can be implemented with a variety of embodiments. Detailed descriptions of several embodiments of the present invention are described as follows:

Embodiment A

An embodiment of the frequency selective medium in accordance with the present invention with arrays of cross-dipoles are shown in FIGS. 1 and 2. FIG. 1 is a plan view of an array of cross-dipoles 6, each of which comprises a vertical dipole 8 and a horizontal dipole 10 made of conductive strips. The vertical and horizontal dipoles 8 and 10 are perpendicular to each other and are preferably of different lengths and widths. The cross-dipole array is positioned on a dielectric substrate 12, a preferred embodiment of which is shown in the sectional view of FIG. 2. The dielectric substrate may include a plurality of dielectric layers of different materials with different dielectric constants. As illustrated in FIG. 2, the substrate includes a center or core layer 14 of a foam or honeycomb material, a top skin layer of a synthetic material 16, preferably of a polyimide, and a bottom skin layer 18 of the same material as the top layer 16. For millimeter wave frequencies, the center layer is preferably a Rohacell® foam, which is a rigid closed cell imide with a dielectric constant of about 1.05. The top and bottom layers 16 and 18 are preferably of a polyimide such as a Kapton® material. The conductive strips 8 of the cross-dipoles 6 are positioned on the top and the bottom surfaces 20 and 22 of the top and bottom dielectric layers 16 and 18, respectively. The frequency selective medium structure of FIGS. 1 and 2 is suitable for the frequency selection of an incident radiation with any linear polarization, either vertical or horizontal. The preferred angle of incidence is about 45°, with a variation of about ±5°. However, it will be appreciated that the principle of the invention is advantageous to selectively discriminate electromagnetic radiation at a wide range of incident angles that are off-normal.

As an illustrative example of a frequency selective medium for millimeter wave frequencies in the range of about 50–60 GHz, the center layer of Rohacell® foam preferably has a thickness of about 4.8006 mm, and the top and bottom Kapton® layers 16 and 18 preferably each have a thickness of about 0.0254 mm. The dielectric constants for the Rohacell® and Kapton® materials are about 1.05 and 3.5, respectively. These materials have sufficient mechanical rigidity for spacecraft applications. The dielectric constants for the substrate materials are not critical as long as the loss tangents are low for the frequencies of interest.

Figure 6:
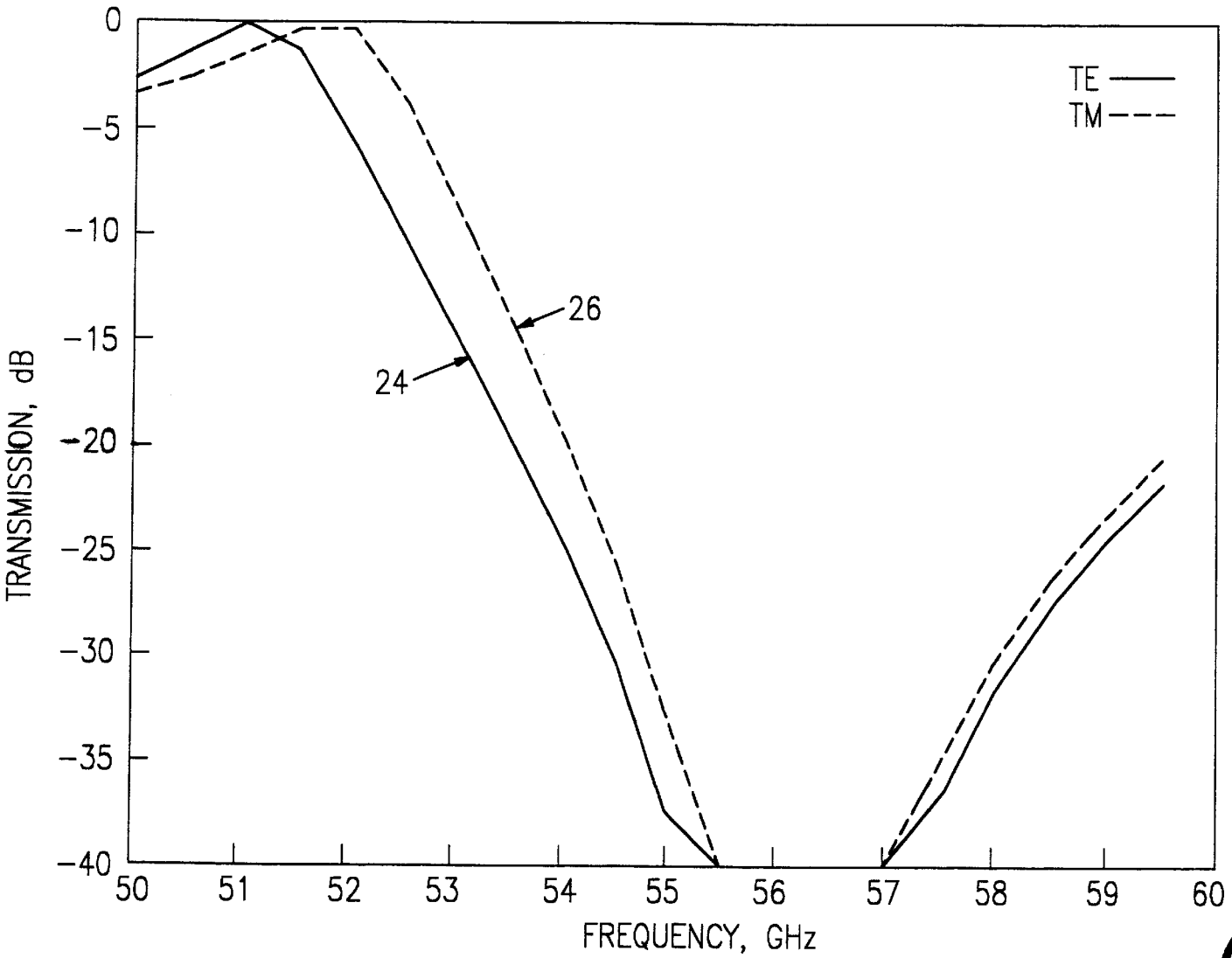
FIG. 6 illustrates a typical frequency response curve for the frequency selective medium of FIGS. 1 and 2 with cross-dipole arrays.

FIG. 3 shows the requirements for a high quality factor (Q) frequency selective medium with specifications for the passband and the stopband. The passband has a center frequency f1 at about 51.3 GHz, with a specification for the transmission of no less than −3 dB. The passband generally has a relatively narrow bandwidth, and it generally has a fractional bandwidth in the range of about 1–5% of the center frequency. The stopband f2 is within a range from about 54.3 to about 58 GHz, with the specification for the transmission of −16.5 dB or less. A frequency selective medium that diplexes two closely separated bands with a transmit frequency of about 51.3 GHz and a stopband or reflection band from about 54.3 to about 58 GHz at a 45° angle of incidence for both TE and TM modes or vertical and horizontal polarizations preferably has the following dimensions for the cross-dipole arrays:

$P_x$=2.54999944 mm $P_y$=2.149856 mm $W_x$=$G_x$=0.15937484 mm $W_y$=$G_y$=0.134366 mm $l_x$=2.3906226 mm $l_y$2.01549 mm where $P_x$ is the center-to-center distance between adjacent vertical dipole strips 8, $P_y$ is the center-to-center distance between adjacent horizontal dipole strips 10, $W_x$ and $W_y$ are the widths of the vertical and horizontal strips, respectively, $G_x$ and $G_y$ are the gaps between adjacent horizontal and vertical dipole strips, respectively, and $l_x$ and $l_y$ are the lengths of horizontal and vertical dipole strips, respectively. The frequency selective medium without a polarizer has strict tolerances on the dimensions, generally on the order of ±0.00762 mm. The frequency response curves of this embodiment are shown in FIG. 6, with a solid curve segment 24 representing the transmission characteristics for incident TE waves at a 45° angle of incidence, and a dashed curve 26 representing the transmission characteristics of an incident TM wave at a 45° angle of incidence. A frequency selective medium with cross-dipole arrays is generally frequency sensitive and has a high quality factor Q, but the bandwidths for the passband and the stopband are generally smaller than the gridded rectangular loop frequency selective media described in embodiments C and D below. With a high Q, a very low insertion loss can be achieved at a designated passband frequency. With this embodiment, a reflection to transmit band ratio of about 54.3/51.3=1.0585 can be achieved so that the passband and the stopband are close to each other. The top and bottom cross-dipole arrays as shown in FIG. 2 preferably have the same dimensions and shapes. However, the top and bottom cross-dipoles need not be aligned with each other, thereby simplifying the manufacturing and quality-control processes. The conductive strips of the cross-dipole arrays can be placed on the substrate's surfaces using conventional techniques such as etching, photolithography, or metal vapor deposition.

Embodiment B

Figure 5:
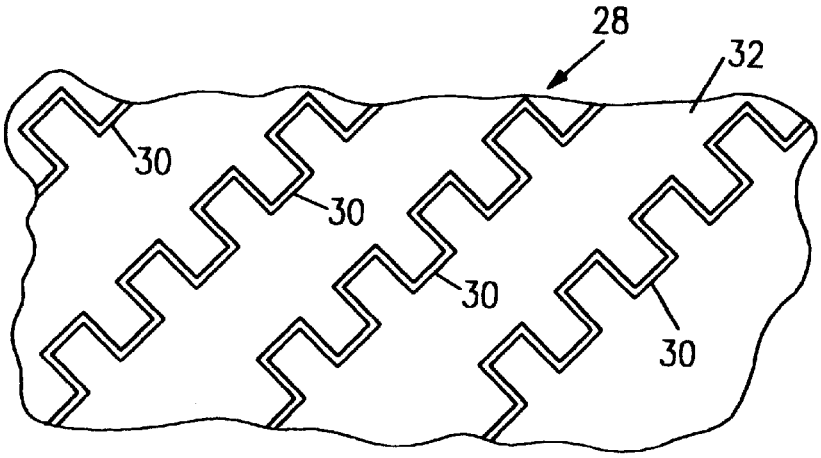
FIG. 5 is a plan view of a portion of the meanderline polarizer of FIG. 4.

FIG. 4 is a sectional view of another embodiment of a frequency selective medium with cross-dipole arrays similar to FIG. 2, but with the addition of a circular polarizer, preferably a conventional meanderline polarizer 28, a plan view of which is shown in FIG. 5. The meanderline polarizer has a plurality of meanderline conductive strips 30 on a dielectric substrate 32. Returning to FIG. 4, the meanderline polarizer 28 is positioned at 45_with respect to the frequency selective medium 33, which is represented by a dashed line that represents the frequency selective medium shown in of FIGS. 1 and 2. As an illustrative example, a linearly polarized incident wave at a passband frequency f1 enters the frequency selective bottom 33 from the bottom of FIG. 4 and passes through the frequency selective medium to enter the circular polarizer 28. When this wave passes through the circular polarizer, it becomes circularly polarized. On the other hand, another incident wave at a stopband frequency f2 strikes the frequency selective medium 33 from the left side of FIG. 4 and is reflected from the frequency selective medium because it is within the stopband. The reflected wave, which is still linearly polarized, passes through the circular polarizer 28 and becomes circularly polarized. When a circular polarizer is used, it is preferred that two incident waves at f1 and f2 both have the same linear polarization, that is, either vertical or horizontal. The circular polarizer 28 converts these waves from a linear polarization to a circular polarization. A circularly polarized wave is the same as a dual-linearly polarized wave with two orthogonal linear polarization components at a phase difference of 90°. The frequency response characteristics of the frequency selective medium of FIG. 4 are generally similar to the frequency response curves of FIG. 6. Compared to Embodiment A, this frequency selective medium with the circular polarizer has less stringent dimensional tolerances, generally on the order of ±0.0127 mm. Therefore, the frequency selective medium of this embodiment is easier to fabricate than that of Embodiment A.

Embodiment C

Figure 7:
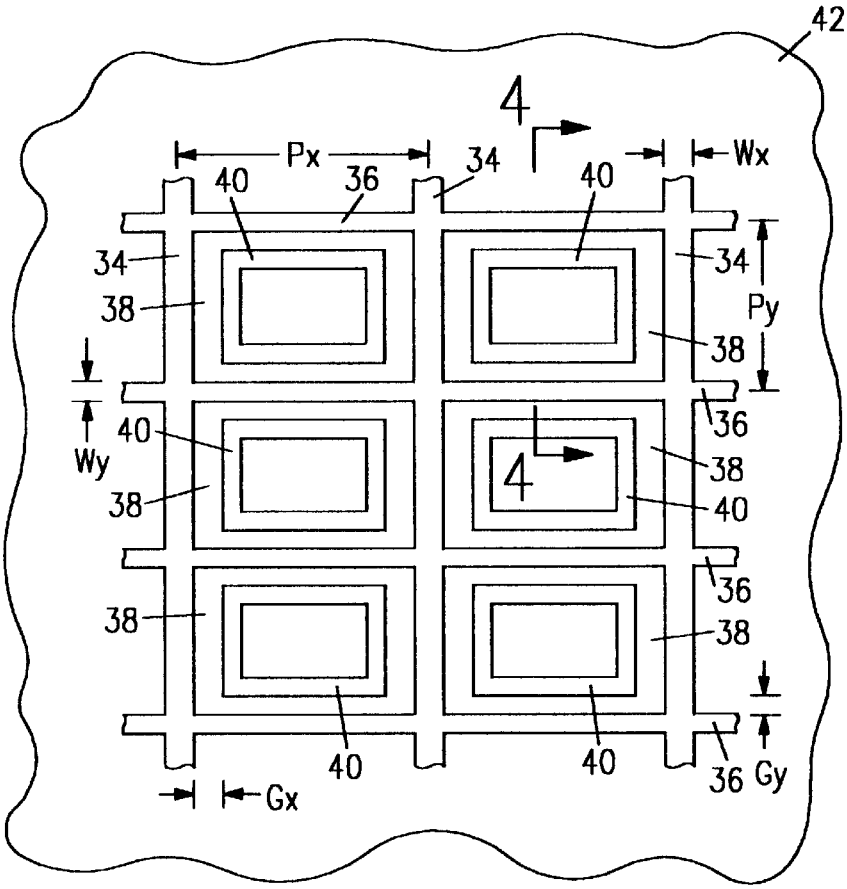
FIG. 7 is a plan view of a portion of a frequency selective medium according to the present invention with arrays of gridded rectangular loops.
Figure 8:
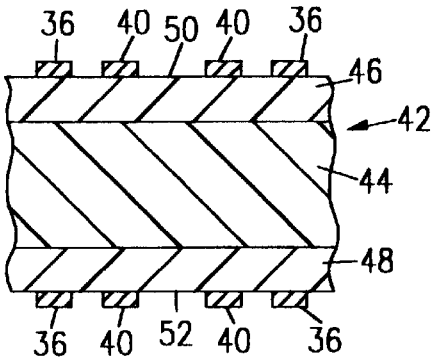
FIG. 8 is a sectional view of the frequency selective medium of FIG. 7 taken along section lines 4—4, with a plurality of dielectric layers forming the substrate.

Another embodiment of the frequency selective medium in accordance with the present invention has arrays of conductive gridded rectangular loops as shown in FIGS. 7 and 8. A plurality of vertical conductive strips 34, which are preferably in parallel with and equally spaced from each other, intersect with a plurality of horizontal conductive strips 36, which are also preferably in parallel with and equally spaced from each other, to form a plurality of rectangular grids 38, each of which preferably having a length different from its width. A plurality of rectangular loops 40 are positioned within respective grids 38. The rectangular loops 40 and the horizontal and vertical conductive strips 36 and 34 are placed on a dielectric substrate 42. A cross-sectional view of the gridded rectangular loop frequency selective medium is shown in FIG. 8, in which the dielectric substrate 42 includes a center or core or layer of a foam or honeycomb material 44 and top and bottom skin layers 46 and 48, respectively, of a synthetic material. For millimeter wave frequencies, the center layer is preferably of a Rohacell® foam material with a dielectric constant of approximately 1.05. The top and bottom layers 46 and 48 are preferably of a Kevlar® material with top and bottom surfaces 50 and 52, respectively. The conductive elements 36 and 40 of gridded rectangular loops are positioned on both the top and bottom surfaces 50 and 52 of the top and bottom dielectric layers 46 and 48, respectively.

As an illustrative example of a gridded rectangular loop frequency selective medium for millimeter wave applications within the frequency range of about 50–60 GHz, with a transmit frequency of about 51.3 GHz and stopband frequencies between about 54.3 to 58 GHz, the thickness of the center foam layer 44 is preferably about 0.4572 mm, and the top and bottom dielectric layers 46 and 48 each have a thickness of about 0.0635 mm. The preferred dimensions of the gridded rectangular loops are as follows:

$P_x$=1.76784 mm $P_y$=1.37414 mm $W_x$=$G_x$=0.11176 mm $W_y$=$G_y$=0.08636 mm where $P_x$ is the center-to-center spacing between adjacent vertical conductive strips 34, $P_y$ is the center-to-center spacing between adjacent horizontal conductive strips 36, $W_x$, and $W_y$ are the widths of vertical and horizontal conductive strips 34 and 36, respectively, and $G_x$ and $G_y$ are the gaps between the vertical and horizontal edges of the rectangular loop 40 and the vertical and horizontal edges of the grid 38, respectively. This embodiment requires strict dimensional tolerances on the order of ±0.00762 mm. The dielectric materials for the substrate layers 44, 46 and 48 preferably have low loss tangent characteristics at millimeter wave frequencies; however, the dielectric constants of these materials are not critical to the invention if the grids' dimensions are designed according to those listed above.

Figure 10:
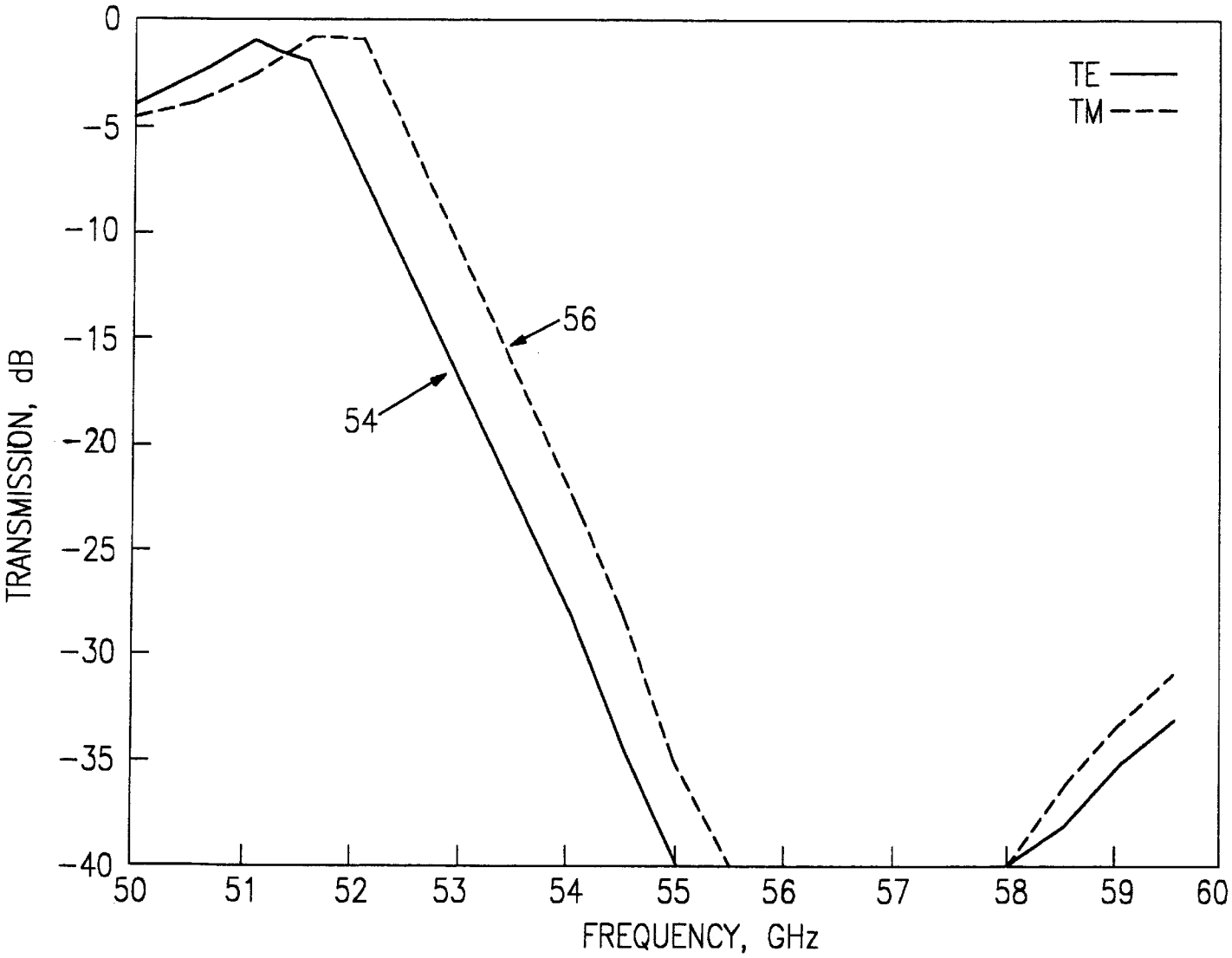
FIG. 10 illustrates a typical frequency response curve of the frequency selective medium of FIGS. 7 and 8 with gridded rectangular loop arrays.

The frequency response characteristics of the gridded rectangular loop frequency selective medium of FIGS. 7 and 8 for the TE and TM modes at a 45° angle of incidence are shown in FIG. 10, with a solid curve 54 representing the transmission of a TE wave and a dashed curve 56 representing the transmission of a TM wave. Compared to the frequency response curves of FIG. 5 for the cross-dipole frequency selective medium, the bandwidths of the passband and the stopband for the gridded rectangular loop arrays are generally wider than those for the cross-dipole arrays. However, the quality factor Q of the gridded rectangular loop frequency selective medium is typically lower than that of a cross-dipole frequency selective medium.

The top and bottom gridded rectangular loop arrays on the top and bottom surfaces preferably have the same dimensions and shapes. However, the top and bottom arrays need not be aligned with respect to each other. The gridded rectangular loop arrays can be placed on the dielectric substrate surfaces by conventional methods such as etching, photolithography, or metal vapor deposition.

Embodiment D

Figure 9:
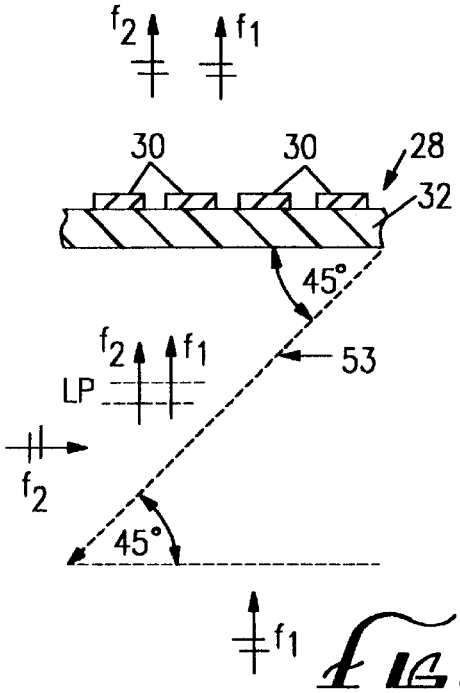
FIG. 9 is a sectional view of a frequency selective medium similar to FIGS. 7 and 8 but with the addition of a meanderline polarizer similar to FIG. 5.

FIG. 9 is a sectional view of a gridded rectangular loop frequency selective medium similar to that shown in FIGS. 6 and 7, but with the addition of a conventional circular polarizer, preferably a meanderline polarizer 28 positioned in the same manner as shown in FIG. 4. A plan view of the meanderline polarizer 28 is shown in FIG. 4, with a plurality of meanderline strips on the surface of a dielectric substrate 32. The meanderline polarizer 28 circularly polarizes a linearly polarized incident wave. FIG. 9 shows a preferred embodiment of the frequency selective medium 53 combined with the meanderline polarizer 28 in the same manner as FIG. 4, except that the frequency selective medium 53 has skin layers comprising gridded rectangular loops as shown in FIGS. 7 and 8 instead of cross-dipole arrays. An incident wave at a passband frequency f1 strikes the frequency selective medium 53 at an angle of 45° from the bottom of FIG. 9, and passes through both the frequency selective medium 53 and the meanderline polarizer 28, which circularly polarizes the linearly-polarized incident wave. Another incident wave at a stopband frequency f2 strikes the frequency selective medium 53 from the left side of FIG. 9, and is reflected by the frequency selective medium. When the linearly polarized reflected wave f2 passes through the circular polarizer 28, it becomes circularly polarized. It is preferred that both incident waves have the same linear polarization, either vertical or horizontal, so that the waves exiting the circular polarizer 28 have the same circular polarization. The dimensional tolerances for the frequency selective medium with the polarizer are on the order of ±0.0127 mm, and therefore the frequency selective medium is easier to fabricate than that of Embodiment C. The frequency selective medium of FIG. 9 also has frequency response characteristics for the TE and TM modes generally similar to the curves 54 and 56, respectively, shown in FIG. 10.

Although the illustrative embodiments as described in Embodiments A–D above apply to the selection of millimeter wave frequencies within the range of about 50–60 GHz, the invention is also applicable to other frequency bands, such as L, S, C, X, Ku, Ka or optical frequency bands within the electromagnetic spectrum. The arrays of conductive elements are not restricted to cross-dipoles or gridded rectangular loops, and the dielectric substrates can be made of different materials optimized for each frequency band.

The present invention has been described in considerable detail with reference to certain preferred versions thereof; however, other versions are possible. Therefore, the spirit and the scope of the appended claims should not be limited to the description of the preferred versions contained herein.

What is claimed is:

1. A frequency selective medium for receiving electromagnetic radiation signals incident at an off normal angle, transmitting signals of a predetermined frequency range and reflecting other frequency signals, said frequency selected medium comprising:

(a) a dielectric substrate having a first surface and a second surface that is substantially parallel with the first surface;

(b) a first array of conductive cross-dipole elements on the first surface;

(c) a second array of conductive cross-dipole elements on the second surface, the first and second arrays each having a conductive surface; and (d) each said conductive cross-dipole element comprising:

i) a horizontal dipole having a first dimension;

ii) a vertical dipole that is substantially perpendicular to the horizontal dipole and having a second dimension that is different from the dimension of the horizontal dipole.

2. The frequency selective medium of claim 1, wherein the angle of incidence is approximately 45°.

3. The frequency selective medium of claim 1, wherein the reflection frequencies are higher than the transmit frequencies.

4. The frequency selective medium of claim 1, wherein:

(a) the transmit frequency band is centered at about 51.3 GHz;

(b) the reflection frequency band is from about 54.3 GHz to about 58 GHz;

(c) the horizontal dipole having a length of about 2.3906226 mm and a width of about 0.134366 mm;

(d) the vertical dipole having a length of about 2.01549 mm and a width of about 0.15937484 mm;

(e) the vertical dipoles each having an adjacent spacing of about 2.54999744 mm; and (f) the horizontal dipoles each having an adjacent spacing of about 2.149856 mm.

5. The frequency selective medium of claim 1, wherein the dielectric substrate comprises a plurality of dielectric layers.

6. The frequency selective medium of claim 1, further comprising a circular polarizer positioned at an angle of 45° with respect to the first and second surfaces.

7. The frequency selective medium of claim 6, wherein the circular polarizer comprises a meanderline polarizer.

8. The frequency selective medium of claim 6, wherein the incident electromagnetic radiation is linearly polarized, and the circular polarizer is adapted to circularly polarize the incident radiation.

9. A frequency selective medium for receiving electromagnetic radiation signals incident at an off normal angle, transmitting signals of a predetermined frequency range and reflecting other frequency signals, said frequency selective medium comprising:

(a) a dielectric substrate having first and second surfaces for receiving a plurality of dipole elements;

(b) a plurality of dipole elements on the first and second surfaces, said dipole elements comprising a plurality of first conductive strips formed in vertical configurations and second conductive strips formed in horizontal configurations, each first and second conductive strip having a first and second length respectively, the first length being different than the second length, said first and second conductive strips configured to provide plurality of rectangular conductive loops each having a length and width that is different from the length, and, (c) a rectangular grid on the first and second surfaces formed of first horizontal elongated conductive strips and first vertical elongated conductive strips, said grid forming a series of rectangular enclosures, wherein each rectangular enclosure contains one of the rectangular conductive loops.

10. The frequency selective medium of claim 9, wherein:

(a) the transmit frequency band is centered at about 51.3 GHz;

(b) the reflection frequency band is from about 54.3 GHz to about 58 GHz;

(c) the rectangular enclosures each having a length of about 1.76784 mm and a width of about 1.37414 mm;

(d) the first horizontal elongated conductive strips each having a width of about 0.08636 mm;

(e) the first vertical elongated conductive strips each having a width of about 0.11176 mm; and (f) each of the rectangular enclosures having a horizontal spacing of about 0.11176 mm and a vertical spacing of about 0.08636 mm from the enclosed rectangular conductive loop.

11. The frequency selective medium of claim 9, wherein the angle of incidence is approximately 45°.

12. The frequency selective medium of claim 9, further comprising a circular polarizer positioned at an angle of 45° with respect to the first and second surfaces.

13. The frequency selective medium of claim 12, wherein the circular polarizer comprises a meanderline polarizer.

14. The frequency selective medium of claim 12, wherein the incident electromagnetic radiation is linearly polarized, and the circular polarizer is adapted to circularly polarize the incident radiation.

15. A frequency selective medium for receiving electromagnetic signals incident at an angle in the range of 40° to 50° and transmitting signals of a predetermined frequency range and reflecting frequency signals in another frequency range, said frequency selective medium comprising:

(a) a dielectric substrate having a first surface and a second surface that is substantially parallel with the first surface;

(b) a plurality of first horizontal conductive strips on each substrate surface, the adjacent first horizontal strips spaced substantially equally from each other at a vertical distance;

(c) a plurality of first vertical conductive strips on each substrate surface, the adjacent first vertical strips spaced substantially equally from each other at a horizontal distance that is different from the vertical distance, the first horizontal and first vertical conductive strips forming an array of rectangular grids on each substrate surface; and, (d) a plurality of rectangular conductive loops formed on the first and second surfaces, each conductive loop formed of second horizontal conductive strips having a first length and second vertical conductive strips having a second length which is different from the first length, wherein each grid enclosing one of the rectangular conductive loops.

16. The frequency selective medium of claim 15, wherein:

(a) the transmit frequency band is centered at about 51.3 GHz;

(b) the reflection frequency band is from about 54.3 GHz to about 58 GHz;

(c) the rectangular grids each having a length of about 1.76784 mm and a width of about 1.37414 mm;

(d) the second horizontal conductive strips each having a width of about 0.08636 mm;

(e) the second vertical conductive strips each having a width of about 0.11176 mm; and (f) each of the rectangular grids having a horizontal spacing of about 0.11176 mm and a vertical spacing of about 0.08636 mm from the enclosed rectangular conductive loop.

17. The frequency selective medium of claim 15, wherein the dielectric substrate comprises a plurality of dielectric layers.

18. The frequency selective medium of claim 15, wherein the angle of incidence is approximately 45°.

19. The frequency selective medium of claim 15, wherein the reflection frequencies are higher than the transmit frequencies.

20. The frequency selective medium of claim 15, wherein the dielectric substrate comprises a plurality of dielectric layers.

21. The frequency selective medium of claim 15, further comprising a circular polarizer positioned at an angle of 45° with respect to the first and second surfaces.

22. The frequency selective medium of claim 21, wherein the circular polarizer comprises a meanderline polarizer.

23. The frequency selective medium of claim 21, wherein the incident electromagnetic radiation is linearly polarized, and the circular polarizer is adapted to circularly polarize the incident radiation.

* * * * *